US012082651B2

(12) United States Patent
Grever et al.

(10) Patent No.: US 12,082,651 B2
(45) Date of Patent: Sep. 10, 2024

(54) FOOTWEAR ARTICLE INCLUDING CUSHION MANAGEMENT SYSTEM

(71) Applicant: R. G. BARRY CORPORATION, Pickerington, OH (US)

(72) Inventors: Andrew Edward Grever, Columbus, OH (US); Luke M. Spoerlein, Columbus, OH (US); Lee F. Smith, Pickerington, OH (US)

(73) Assignee: R. G. BARRY CORPORATION, Pickerington, OH (US)

( * ) Notice: Subject to any disclaimer, the term of this patent is extended or adjusted under 35 U.S.C. 154(b) by 43 days.

(21) Appl. No.: 16/577,497

(22) Filed: Sep. 20, 2019

(65) Prior Publication Data

US 2021/0085020 A1 Mar. 25, 2021

(51) Int. Cl.
*A43B 7/142* (2022.01)
*A43B 13/12* (2006.01)
*A43B 13/40* (2006.01)

(52) U.S. Cl.
CPC ..... *A43B 7/142* (2013.01); *A43B 13/125* (2013.01); *A43B 13/40* (2013.01)

(58) Field of Classification Search
CPC ..... A43B 7/14; A43B 7/145; A43B 7/1425; A43B 7/146; A43B 7/1495; A43B 7/06; A43B 7/08; A43B 13/125; A43B 13/12; A43B 13/127; A43B 13/122; A43B 13/40; A43B 7/142; A43B 13/143; A43B 13/145; A43B 13/184; A43B 13/26; A43B 7/143; A43B 17/00; A43B 5/0437; A43B 5/0441; A43B 23/22
See application file for complete search history.

(56) References Cited

U.S. PATENT DOCUMENTS 875,517 A * 12/1907 Gefvert ..... A43B 7/142 36/159
918,101 A * 4/1909 Toporczer ..... A43B 7/142 36/168
1,044,015 A * 11/1912 Byrne ..... A43B 7/142 36/147
1,125,134 A * 1/1915 Lee ..... A43B 7/142 36/44
1,129,039 A * 2/1915 Lobel et al. ..... A43B 7/142 152/416
1,136,443 A * 4/1915 Scholl ..... A43B 7/142 36/155

(Continued)

FOREIGN PATENT DOCUMENTS

CA 2182140 A1 1/1997

*Primary Examiner* — Heather Mangine
*Assistant Examiner* — Raquel M. Weis
(74) *Attorney, Agent, or Firm* — Vorys, Sater, Seymour and Pease LLP; Khaled Shami

(57) ABSTRACT

A footwear article can include a sole having an outsole, a midsole, and an insole. The footwear article can further include an arch support member connected to a medial side arch region of the midsole. The arch support member can have a plurality of arch cushion towers extending upwards from an upper surface of the midsole. The footwear article can also include an upper affixed to the midsole. The insole can be disposed such that the insole covers the upper surface of the midsole and the arch support member.

14 Claims, 7 Drawing Sheets

(56) References Cited

U.S. PATENT DOCUMENTS 1,208,176 A * 12/1916 Littman ..... A43B 7/142 36/158
1,238,493 A * 8/1917 Callahan ..... A43B 7/142 36/159
1,246,789 A * 11/1917 Runkel ..... A43B 7/142 36/168
1,378,398 A * 5/1921 Block ..... A43B 7/1435 36/159
1,456,758 A * 5/1923 Bernat ..... A43B 7/223 36/158
1,464,994 A * 8/1923 Levitt ..... A43B 7/1445 36/164
1,470,618 A * 10/1923 Craine ..... A43B 7/142 36/179
1,476,915 A * 12/1923 O'Donnell ..... A43B 7/142 36/147
1,517,170 A * 11/1924 Rosenthal ..... A43B 7/14 36/43
1,526,608 A * 2/1925 Rakonick ..... A43B 7/14 36/165
1,590,852 A * 6/1926 Rakonick ..... A43B 7/14 36/165
1,596,925 A * 6/1926 Falcone ..... A43B 7/1466 36/157
1,676,415 A * 7/1928 Saperston ..... A43B 7/223 36/146
1,697,589 A * 1/1929 Cort ..... A43B 7/1445 36/3 R
1,843,517 A * 2/1932 Ramsey ..... A43B 9/06 12/142 F
1,957,695 A * 5/1934 Chiappetta ..... A43B 7/223 36/181
2,001,821 A * 5/1935 Everston ..... A43B 7/142 36/169
2,027,757 A * 1/1936 Whitfield ..... A43B 7/223 36/147
2,036,890 A * 4/1936 Slater ..... A43B 7/22 36/180
2,043,396 A * 6/1936 Schnellbacher ..... A43B 7/223 36/158
2,067,963 A * 1/1937 Joyce ..... A43B 3/108 36/28
2,095,532 A * 10/1937 Rigandi ..... A43B 7/06 36/147
2,129,321 A * 9/1938 Guerin ..... A43B 7/22 36/158
2,178,651 A * 11/1939 Seigle ..... A43B 7/1415 36/168
2,236,779 A * 4/1941 Muller ..... A43B 7/14 36/43
2,351,818 A * 6/1944 Joyce, Jr. ..... A43B 9/14 36/19.5
2,400,269 A * 5/1946 Stritter ..... A43B 7/142 36/22 A
2,412,226 A * 12/1946 Margolin ..... A43B 7/14 36/147
2,943,405 A * 7/1960 Olson ..... A43B 7/142 36/173
3,028,857 A * 4/1962 Parker ..... A61H 36/00 D2/744
3,077,886 A * 2/1963 Pirhonen ..... A43B 7/142 36/166
3,339,555 A * 9/1967 Rotko ..... A43B 7/1468 36/165
3,589,037 A * 6/1971 Gallagher ..... A43B 17/03 36/4
3,662,478 A * 5/1972 Schwab ..... A43B 13/223 36/59 C
3,722,113 A * 3/1973 Birkenstock ..... A43B 7/142 36/43
3,757,774 A * 9/1973 Hatuno ..... A61H 7/001 36/141
3,828,792 A * 8/1974 Valenta ..... A43B 13/40 36/178
4,033,054 A * 7/1977 Fukuoka ..... A43B 7/146 601/134
4,045,886 A * 9/1977 Terasaki ..... A43B 7/1445 36/44
4,047,310 A * 9/1977 Sunoo ..... A43B 7/141 601/134
4,075,772 A * 2/1978 Sicurella ..... A43B 7/146 36/43
4,219,945 A * 9/1980 Rudy ..... A43B 13/203 36/44
4,345,387 A * 8/1982 Daswick ..... A43B 13/14 36/43
4,598,484 A * 7/1986 Ma ..... A43B 7/1466 36/43
4,674,203 A * 6/1987 Goller ..... A43B 17/00 36/141
4,694,831 A * 9/1987 Seltzer ..... A43B 7/146 601/134
4,733,483 A * 3/1988 Lin ..... A43B 1/0072 36/28
4,760,655 A * 8/1988 Mauch ..... A43B 7/146 36/43
4,813,157 A * 3/1989 Boisvert ..... A43B 7/22 36/145
4,823,799 A * 4/1989 Robbins ..... A43B 7/146 36/129
4,843,738 A * 7/1989 Masuda ..... A43B 17/14 36/43
4,843,741 A * 7/1989 Yung-Mao ..... A43B 13/184 36/114
4,852,273 A * 8/1989 Hamy ..... A43B 7/141 36/28
4,881,328 A * 11/1989 Yung-Mao ..... A43B 17/02 36/107
D305,954 S * 2/1990 Kin ..... D2/961
4,905,382 A * 3/1990 Yung-Mao ..... A43B 13/184 36/107
5,035,068 A * 7/1991 Biasi ..... A43B 17/08 36/43
5,400,526 A * 3/1995 Sessa ..... A43B 7/081 36/3 R
5,551,173 A * 9/1996 Chambers ..... A43B 7/146 36/141
5,572,804 A * 11/1996 Skaja ..... A43B 13/20 36/35 B
5,577,334 A * 11/1996 Park ..... A43B 7/142 36/35 R
5,595,005 A * 1/1997 Throneburg ..... A43B 7/14 36/31
5,664,342 A * 9/1997 Buchsenschuss ..... A43B 7/146 36/43
5,685,094 A * 11/1997 Lin ..... A43B 1/0054 36/43
5,787,608 A * 8/1998 Greenawalt ..... A61F 5/14 36/169
5,860,229 A * 1/1999 Morgenstern ..... A43B 7/1464 36/141
5,903,985 A * 5/1999 DeMarchi ..... A43B 7/1464 36/156
6,061,928 A * 5/2000 Nichols ..... A43B 13/181 36/28
6,345,455 B1 * 2/2002 Greer, Jr. ..... A61F 5/14 36/161
6,425,194 B1 7/2002 Brie
6,434,859 B1 * 8/2002 Kim ..... A43B 7/146 36/43
6,931,763 B2 * 8/2005 Bray, Jr. ..... A43B 13/42 36/11
7,430,820 B2 * 10/2008 Andreoli ..... A43B 7/223 36/71
7,555,851 B2 * 7/2009 Hazenberg ..... A43B 13/141 36/102
7,793,437 B2 * 9/2010 Chapman ..... A43B 7/141 36/142

(56) References Cited

U.S. PATENT DOCUMENTS 7,886,461 B2 * 2/2011 Sato ..... A43B 13/183 36/27
7,997,010 B2 * 8/2011 Rosenbaum ..... A43B 13/223 36/76 R
8,178,022 B2 * 5/2012 Schindler ..... A61K 31/713 264/261
8,839,530 B2 * 9/2014 Smith ..... A43B 13/40 36/12
9,003,677 B2 * 4/2015 Goodsmith ..... A43B 13/145 36/103
9,009,988 B2 * 4/2015 Jacobs ..... A43B 7/143 36/28
9,210,965 B2 * 12/2015 O'Connor ..... A43B 3/108
9,491,985 B2 * 11/2016 Lubart ..... A43B 13/22
9,498,019 B2 * 11/2016 Westmoreland ..... A43B 13/026
9,717,303 B2 * 8/2017 Walker ..... A43B 13/141
9,839,260 B1 * 12/2017 Chang ..... A43B 7/142
9,913,508 B2 * 3/2018 Tzeng ..... A43B 1/0081
9,930,929 B2 * 4/2018 Cooper ..... A43B 13/122
9,955,749 B2 * 5/2018 Van Atta ..... A43B 7/148
10,188,172 B1 * 1/2019 Wurtz ..... A43B 17/00
10,349,700 B2 * 7/2019 Amis ..... B29D 35/122
10,743,607 B2 * 8/2020 Amis ..... B29D 35/122
2001/0001907 A1 * 5/2001 Luthi ..... A43B 7/1425 36/144
2001/0052194 A1 * 12/2001 Nishiwaki ..... A43B 7/144 36/35 R
2002/0092201 A1 * 7/2002 Kraeuter ..... A43B 7/145 36/28
2003/0005600 A1 * 1/2003 Kita ..... A43B 13/41 36/76 R
2003/0126770 A1 * 7/2003 Chen ..... A43B 7/142 36/141
2003/0150131 A1 * 8/2003 McManus ..... A43B 7/1445 36/28
2003/0150134 A1 * 8/2003 Hardt ..... A43B 7/144 36/145
2003/0221336 A1 * 12/2003 Krstic ..... A43B 23/028 36/93
2004/0078996 A1 * 4/2004 Brooks ..... A43B 7/144 36/3 R
2004/0098882 A1 * 5/2004 Tuan ..... A43B 17/03 36/29
2005/0000114 A1 * 1/2005 Mick ..... A43B 7/142 36/43
2005/0034328 A1 * 2/2005 Geer ..... A43B 3/0052 36/31
2005/0049533 A1 * 3/2005 Beiruti ..... A43B 17/08 601/134
2006/0021252 A1 * 2/2006 Throneburg ..... A43B 17/18 36/28
2006/0080862 A1 * 4/2006 Hay ..... A43B 7/145 36/25 R
2007/0169379 A1 * 7/2007 Hazenberg ..... A43B 13/141 36/102
2008/0022561 A1 * 1/2008 Klavano ..... A43B 7/146 36/141
2008/0127518 A1 * 6/2008 Byrne ..... A43B 7/1445 36/97
2008/0229617 A1 * 9/2008 Johnson ..... A43B 3/0057 36/102
2009/0038179 A1 * 2/2009 Chen ..... A43B 17/003 36/41
2009/0165334 A1 * 7/2009 Kantro ..... A43B 7/22 36/43
2009/0172972 A1 * 7/2009 Rosen ..... A43B 7/1464 36/43
2011/0099845 A1 * 5/2011 Miller ..... A43B 13/18 36/91
2011/0173842 A1 * 7/2011 Hong ..... A43B 7/146 36/91
2011/0179672 A1 * 7/2011 Cheng ..... A43B 17/08 36/71
2011/0239489 A1 * 10/2011 Iuchi ..... A43B 13/141 36/25 R
2011/0289798 A1 * 12/2011 Jung ..... A43B 7/146 36/91
2011/0302805 A1 * 12/2011 Vito ..... A43B 7/1464 36/145
2011/0308106 A1 * 12/2011 Lim ..... A43B 7/1445 36/28
2012/0060395 A1 * 3/2012 Blevens ..... A43B 21/32 36/35 R
2012/0246971 A1 * 10/2012 Donzis ..... A43B 7/1425 36/43
2013/0185955 A1 * 7/2013 Cheng ..... A43B 7/145 36/28
2013/0219744 A1 * 8/2013 Case ..... A43B 17/023 36/43
2013/0283638 A1 * 10/2013 Diepenbrock ..... A43B 13/40 36/44
2014/0033565 A1 * 2/2014 Aruin ..... A43B 7/149 36/43
2014/0259769 A1 * 9/2014 Bjornson ..... A43B 13/14 36/28
2014/0310981 A1 * 10/2014 Abshire ..... A43B 7/1425 36/28
2015/0143714 A1 * 5/2015 Tzeng ..... A43B 7/143 36/43
2016/0007671 A1 * 1/2016 Prust ..... A43B 17/08 297/219.11
2016/0021972 A1 * 1/2016 Grelle ..... A43B 13/12 36/140
2016/0309838 A1 * 10/2016 Ha ..... A43B 7/146
2017/0027277 A1 * 2/2017 Anthony ..... A43B 7/28
2017/0119091 A1 * 5/2017 Bischoff ..... A43B 13/188
2017/0127753 A1 * 5/2017 Kohatsu ..... A43B 7/142
2017/0127756 A1 * 5/2017 LaFortune ..... A43B 13/223
2017/0258176 A1 * 9/2017 Waatti ..... A43B 7/141
2017/0367438 A1 * 12/2017 Del Biondi ..... A43B 13/223
2018/0008000 A1 * 1/2018 Chanda ..... B33Y 80/00
2018/0014606 A1 * 1/2018 Mokos ..... A43B 13/04
2018/0077997 A1 * 3/2018 Hoffer ..... B32B 25/047
2018/0168285 A1 6/2018 Cooper
2018/0177261 A1 * 6/2018 Amis ..... A42B 3/063
2018/0192739 A1 * 7/2018 Granger ..... A43B 17/14
2018/0303197 A1 * 10/2018 Chen ..... A43B 13/223
2019/0053571 A1 * 2/2019 Bjornson ..... A43B 13/145
2019/0239596 A1 * 8/2019 Ploem ..... A43B 13/12
2020/0008522 A1 * 1/2020 Kim ..... A43B 17/02
2020/0275739 A1 * 9/2020 Linkfield ..... A43B 13/223

* cited by examiner

FOOTWEAR ARTICLE INCLUDING CUSHION MANAGEMENT SYSTEM

BACKGROUND

Footwear can be used to accomplish various goals, including daily wear comfort, arch support (e.g., at the medial side arch region of the foot), foot and joint pain relief, orthopedic correction and athletic performance improvement, among other things. In particular, arch support is important to help distribute pressure across the wearer's arches, provide stability and balance, provide support, and lessen foot pain.

However, while these goals of footwear are important, wearers often select footwear for purposes of fashion instead of or in addition to the effectiveness of the cushioning. Thus, it is sometimes beneficial to supplement the cushioning provided in a footwear article with cushioning inserts. Inserts can be placed in various positions in the footwear article, including above the insole, below the insole, attached to the outsole, and the like.

Further, each wearer's feet are unique, and can benefit from differently shaped arch support. Moreover, the same wearer can have differently shaped feet, requiring different arch support structures. Accordingly, it can be impractical to provide individualized support for each wearer.

For all of these reasons, there is a need for a footwear article cushioning that is adaptable to a wearer's foot, and that provides support in the medial side arch region.

SUMMARY

It is to be understood that both the following general description and the following detailed description are exemplary and explanatory only and are not restrictive. Provided is a footwear article having adaptable cushioning including a cushion management system.

In a first aspect, a footwear article can include a sole having an outsole, a midsole, and an insole. The footwear article can further include an arch support member connected to a medial side arch region of the midsole. The arch support member can have a plurality of arch cushion towers extending upwards from an upper surface of the midsole. The footwear article can also include an upper affixed to the midsole. The insole can be disposed such that the insole covers the upper surface of the midsole and the arch support member.

In a second aspect, a sole for a footwear article can include an outsole having a lower surface and an upper surface. The lower surface of the outsole can include a plurality of tread elements. The sole can further include a midsole affixed to the upper surface of the outsole. An arch support member can be connected to a medial side arch region of the midsole. The arch support member can include a plurality of arch cushion towers extending upwards from an upper surface of the midsole. The sole can further include an insole having an upper surface and a lower surface. The insole can define a cavity in the lower surface sized to receive the arch support member.

In a third aspect, an arch support member for use in a footwear article can comprise a substantially planar base and a plurality of arch cushion towers extending upward substantially orthogonally to the base. Each of the arch support towers can include an upper surface configured to interface with an arch of a foot. The base can be configured to be attached to a medial side arch region of the footwear article.

Additional advantages will be set forth in part in the description which follows or may be learned by practice. The advantages will be realized and attained by means of the elements and combinations particularly pointed out in the appended claims.

BRIEF DESCRIPTION OF THE DRAWINGS

The accompanying drawings, which are incorporated in and constitute a part of this specification, illustrate embodiments and together with the description, serve to explain the principles of the methods and systems.

DETAILED DESCRIPTION

Figure 1:
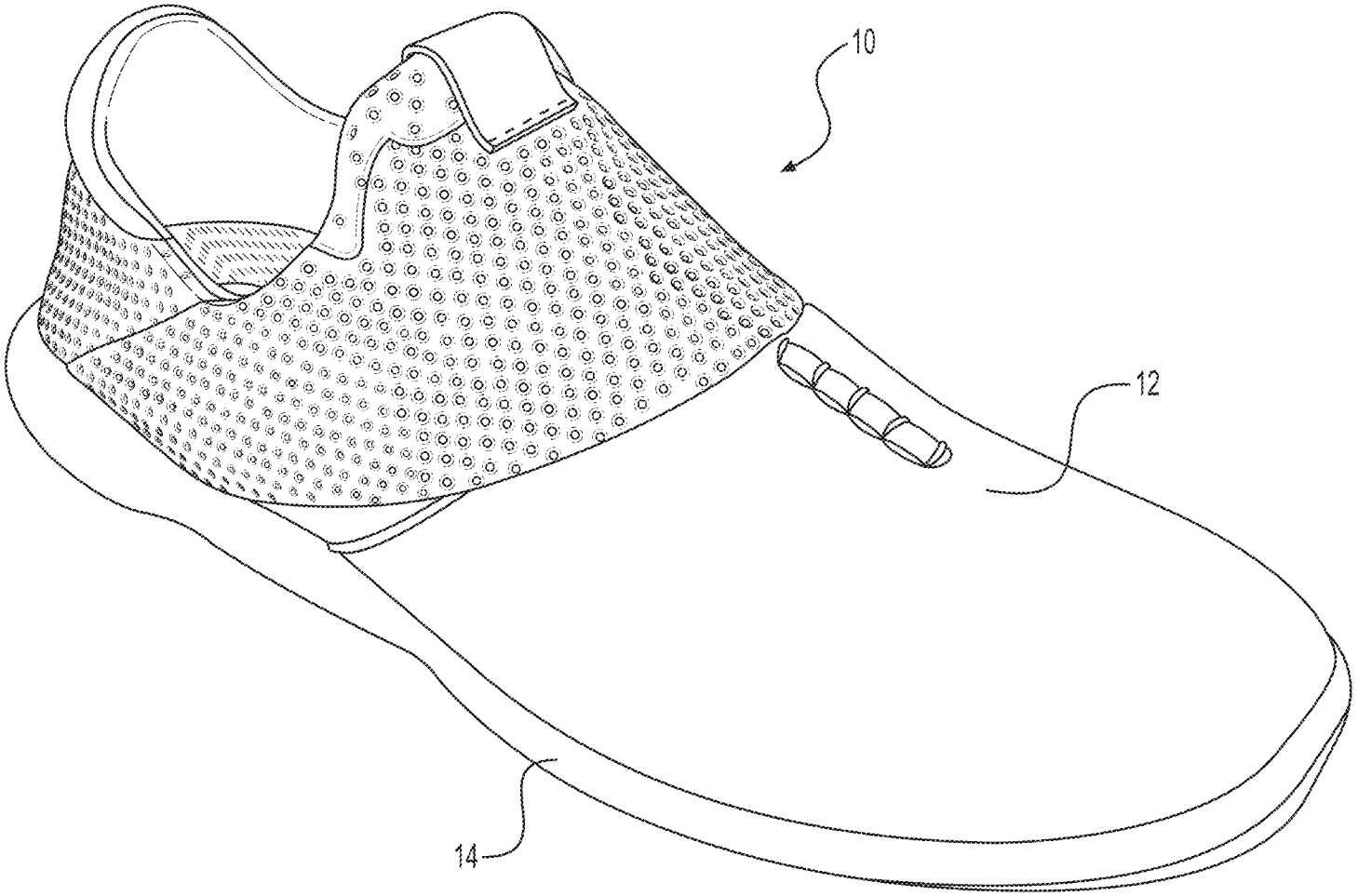
FIG. 1 is a perspective view of a footwear article according to the present invention.

Before the present article is disclosed and described, it is to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

The present disclosure relates to footwear articles including a cushion management system. The footwear article can comprise an upper attached to a sole. The sole can include the cushion management system. In particular, the cushion management system can comprise a molded outsole and midsole, which can be formed as a single unit. The midsole can comprise a plurality of arch cushion towers extending upward from the midsole and positioned in a metatarsal region of the midsole. The arch cushion towers can extend vertically upward from an upper surface of the midsole, such that the arch cushion towers are able to support arches of varying shapes. In some aspects, the arch cushion towers can have a generally rectangular shape at their base, with an angled or arcuate top surface designed to support the foot. In other aspects, the arch cushion towers can have different shapes. For example, the arch cushion towers can have a base that is generally circular, generally polygonal (e.g., hexagonal, octagonal, or the like), generally oval-shaped, or any other shape suitable for supporting the foot (e.g., at the medial side arch region of the foot). The cushion management system can further comprise a molded, cushioned insole that rests atop the outsole/midsole. The insole can comprise a recessed area that accommodates the arch cushion towers.

The upper can be constructed and arranged to keep the footwear article secured to the foot. The upper is preferably made from a soft, flexible material, such as a fabric, rubber, or leather. The upper can be connected to the sole by stitching, plastic welding, and/or chemical adhesive. Alternatively, the upper can be molded directly to the outsole and/or midsole.

The sole can comprise an outsole, including a lower surface and an upper surface. The footwear article can further comprise a midsole having an upper surface and a lower surface. The lower surface of the outsole can comprise a tread extending substantially orthogonally from the lower surface of the outsole. In some aspects, the tread can extend further from the lower surface of the outsole in a heel portion and/or a ball portion of the footwear article. In some aspects, the tread can be formed from a compressible material, such that when the article is compressed between the ground and a wearer, the tread compresses, absorbing at least a portion of an impact from the step. In some aspects, the outsole can be formed from, for example, a thermoplastic rubber material. In other aspects, such as when the footwear article is designed for primarily indoor wear (e.g., for slippers and the like), the outsole can be formed from an ethylene vinyl acetate (EVA) foam rubber.

The sole can further comprise a midsole having an upper surface and a lower surface. In some aspects, the midsole can be attached to the outsole, such that the lower surface of the midsole is adjacent to the upper surface of the outsole. In other aspects, the midsole and the outsole can be formed as a single structure. The midsole can be formed from a cushion material, such as an EVA foam rubber, a polyurethane, and/or other cushion materials known in the art.

The sole can further comprise an arch support member located in the medial side arch region of the footwear article. The arch support member can comprise a planar base and a plurality of arch cushion towers extending upward from the base. Each of the plurality of arch cushion towers can have an upper surface contoured to interface with a wearer's foot. In some aspects, the plurality of arch cushion towers can be arranged in one or more rows. In some aspects, the arch support member can be connected to the midsole. As one example, the arch support member can be formed as a separate component and attached to the midsole. For example, the arch support member can be attached to the midsole by a chemical adhesive, by a plastic welding process, or by other means known in the art. In other aspects, the arch support member can be formed as an arch support portion of the midsole, such that the midsole and the base of the arch support member are formed as a single unit. In some aspects, the arch support member (or arch support portion) can be formed from, for example, an EVA foam rubber The sole can further comprise an insole. The insole can be a molded, cushioned insole. In some aspects, the insole can be affixed to the midsole, such as by an adhesive. In other aspects, the insole can rest atop the midsole. The insole can comprise a recessed area that accommodates the arch cushion towers. The insole can be formed from one or more cushioning materials, including EVA, memory foam, and other cushioning materials known in the art. In some aspects the insole can be perforated to facilitate airflow through the footwear article.

Referring now to FIG. 1, a footwear article 10 is shown. The footwear article 10 can comprise an upper 12 and a sole 14. The upper 12 can be affixed to the sole 14 via known methods, such as stitching, adhesive, plastic welding, and/or the like. While FIG. 1 shows a shoe, it will be understood that other footwear articles are contemplated.

Figure 2:
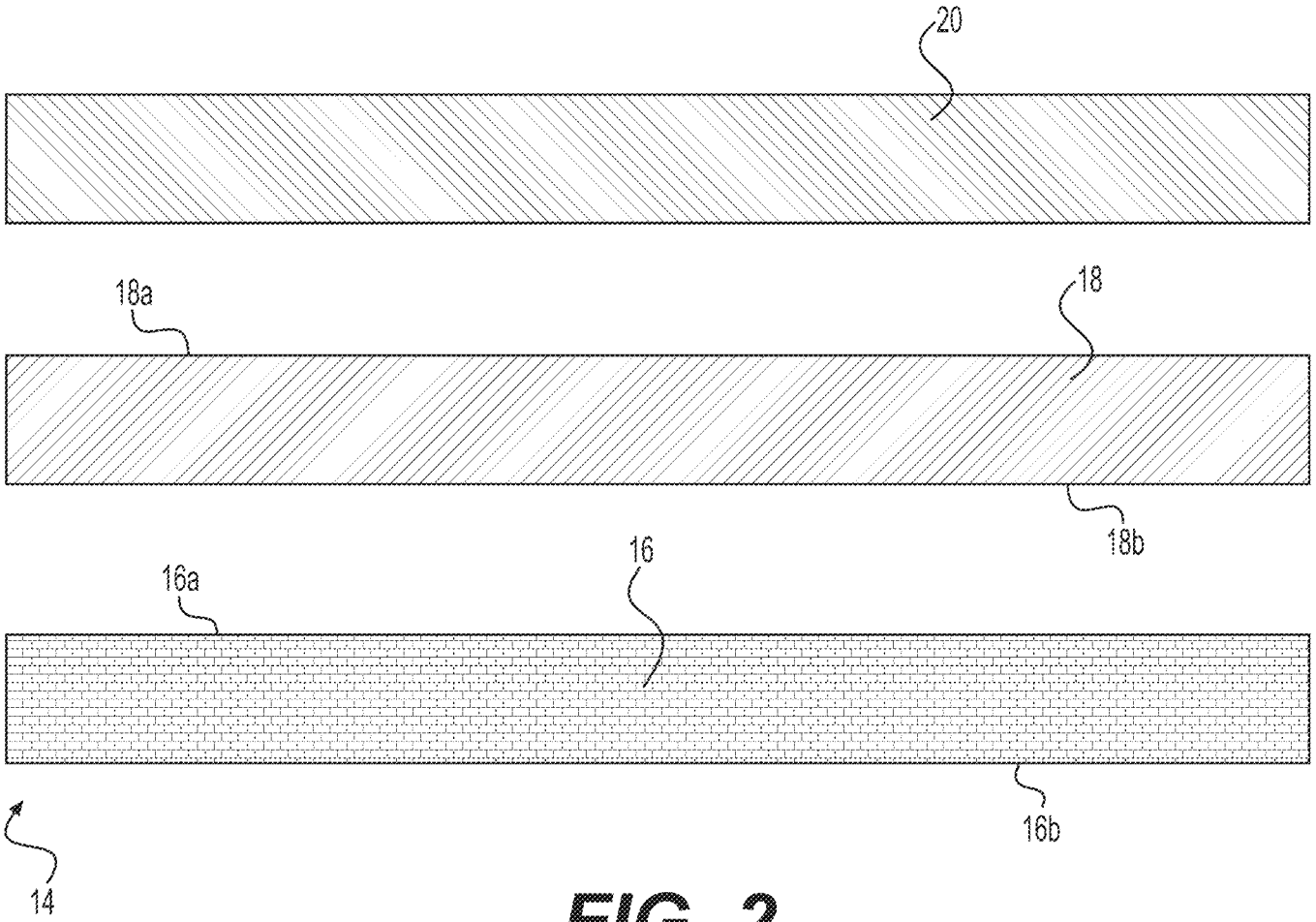
FIG. 2 is an exploded view of a sole of the footwear article according to the present invention.

FIG. 2 shows an exploded view of the sole 14. The sole 14 can comprise an outsole 16, a midsole 18, and an insole 20. The outsole can comprise an upper surface 16*a* and a lower surface 16*b*. Similarly, the midsole can comprise an upper surface 18*a* and a lower surface 18*b*. In some aspects, the outsole 16 can be formed from a compressible material, such that when the article is compressed between the ground and a wearer, the outsole 16 can absorb at least a portion of an impact from the weight transfer. In some aspects, the outsole 16 can be formed from, for example, a thermoplastic rubber material. In other aspects, the outsole 16 can be formed from an ethylene vinyl acetate (EVA) foam rubber. The midsole 18 can be formed from an EVA foam rubber and/or a polyurethane.

Figure 3:
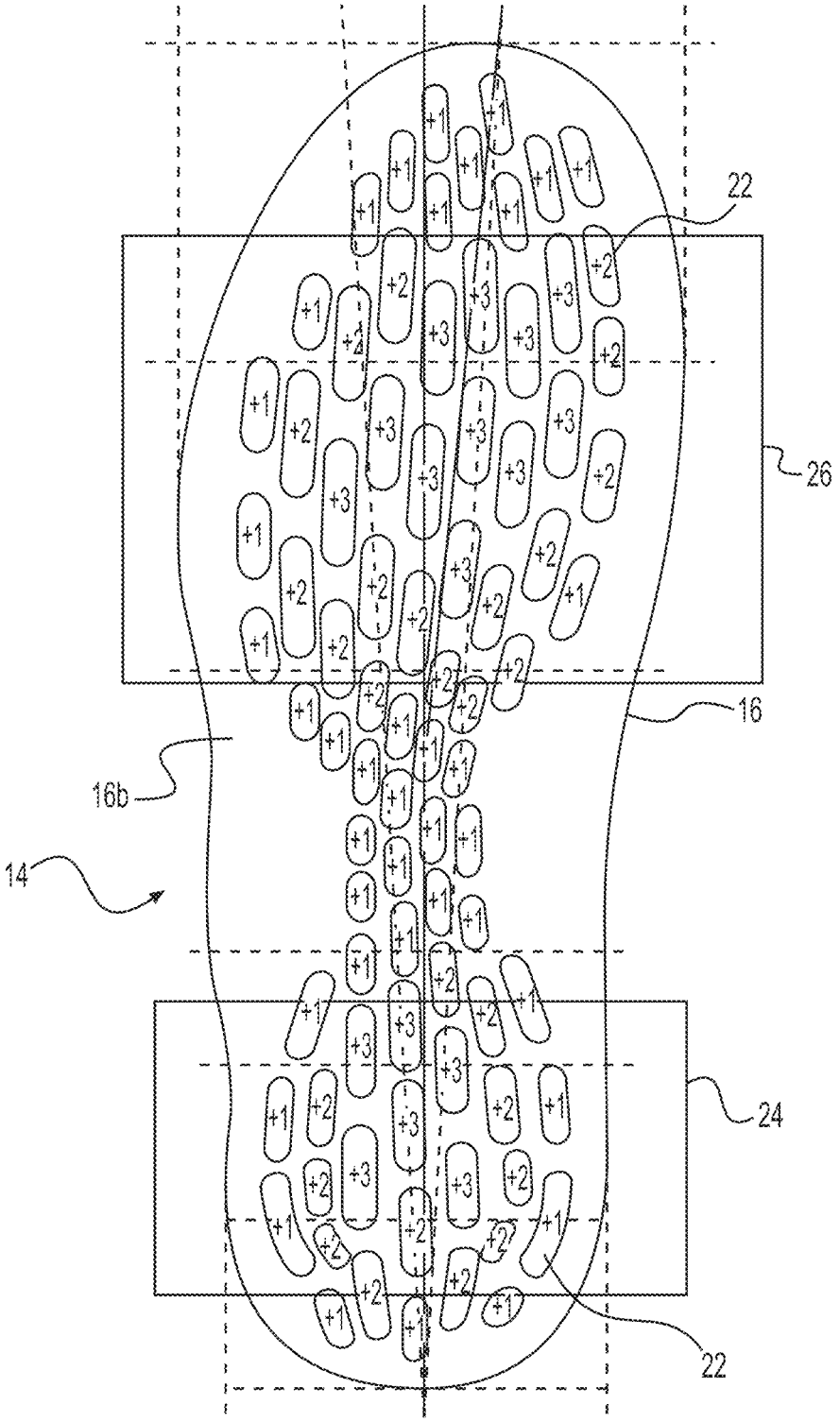
FIG. 3 is a bottom plan view of an outsole of the footwear article according to the present invention.

FIG. 3 shows a bottom view of the footwear article 10. The lower surface 16*b* of the outsole 16 can comprise a plurality of tread members 22 extending from the lower surface of the outsole. In some aspects, the tread members 22 can extend substantially orthogonally from the lower surface 16*b*. In some aspects, the tread members 22 can extend by varying amounts. For example, the tread members 22 can extend further from the lower surface 16*b* of the outsole 16 in a heel portion 24 and/or a ball portion 26 of the footwear article 10. As another example, tread members closer to an axis extending from a heel portion of the footwear article 10 to a toe portion of the footwear article can extend further from the lower surface 16*b* of the outsole 16. In some aspects, the tread members 22 can be divided into a plurality of groups, with each group extending a different distance from the lower surface 16*b* of the outsole 16. For example, the tread members can be divided into three groups based on positions of the individual tread members. In some aspects, the tread members 22 can be formed form the same material used to form the outsole 16. As one of skill in the art will recognize, other patterns of the tread members 22 can be used without departing from the scope of the invention.

Figure 4:
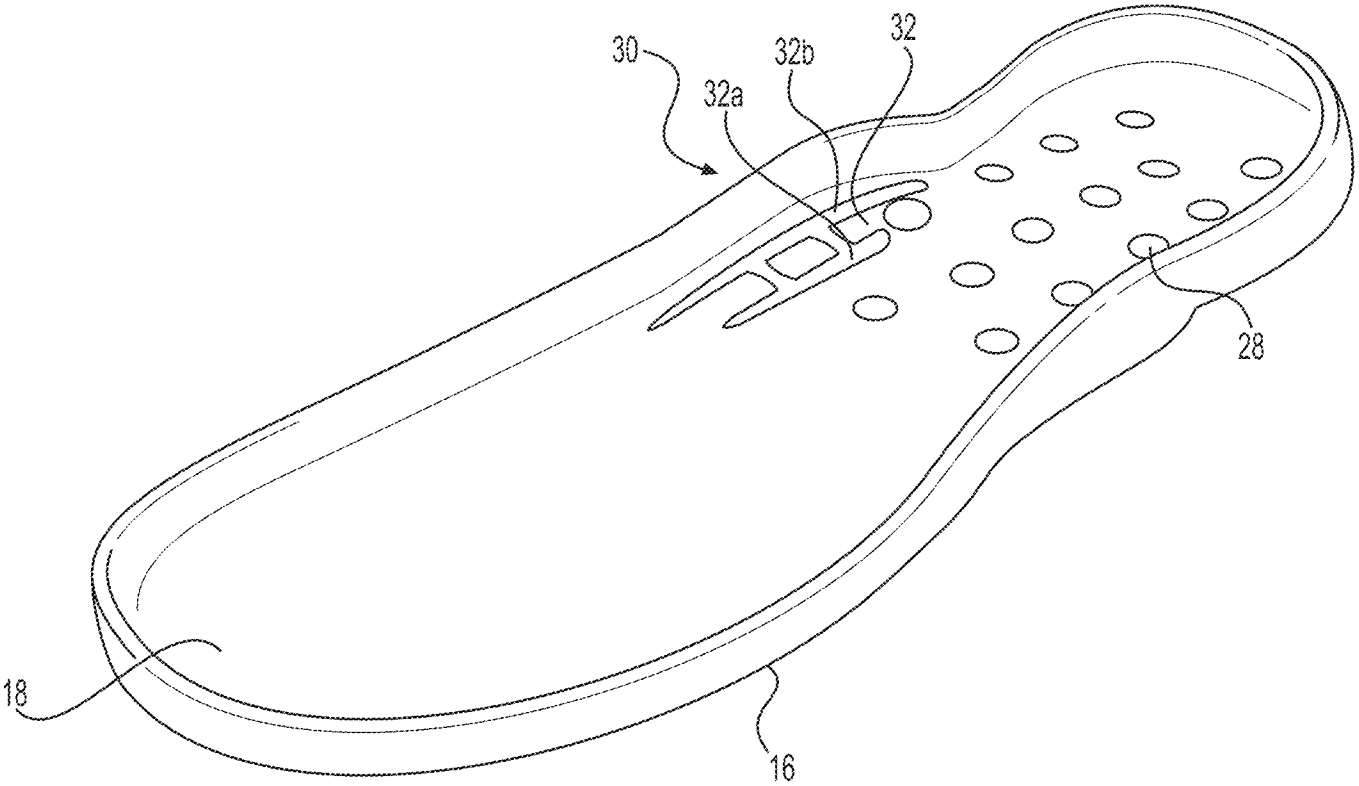
FIG. 4 is a perspective view of a midsole and outsole of the footwear article according to the present invention.

FIG. 4 shows a perspective view of an outsole 16 and midsole 18. As shown in FIG. 4, the outsole 16 and midsole 18 can be formed as a single structure. In other aspects, the midsole 18 can be attached to the outsole 16 such that the lower surface 18*b* of the midsole 18 is adjacent to the upper surface 16*a* of the outsole 16. The midsole 18 can define cavities 28, which can extend downward from the upper surface 18*a*. The cavities 28 can help to improve flexibility of the midsole 18. In some aspects, the midsole 18 can further comprise one or more grooves extending substantially transversely across the midsole in a portion of the sole forward of the metatarsal region. The grooves can improve flexibility of the midsole.

Figure 5:
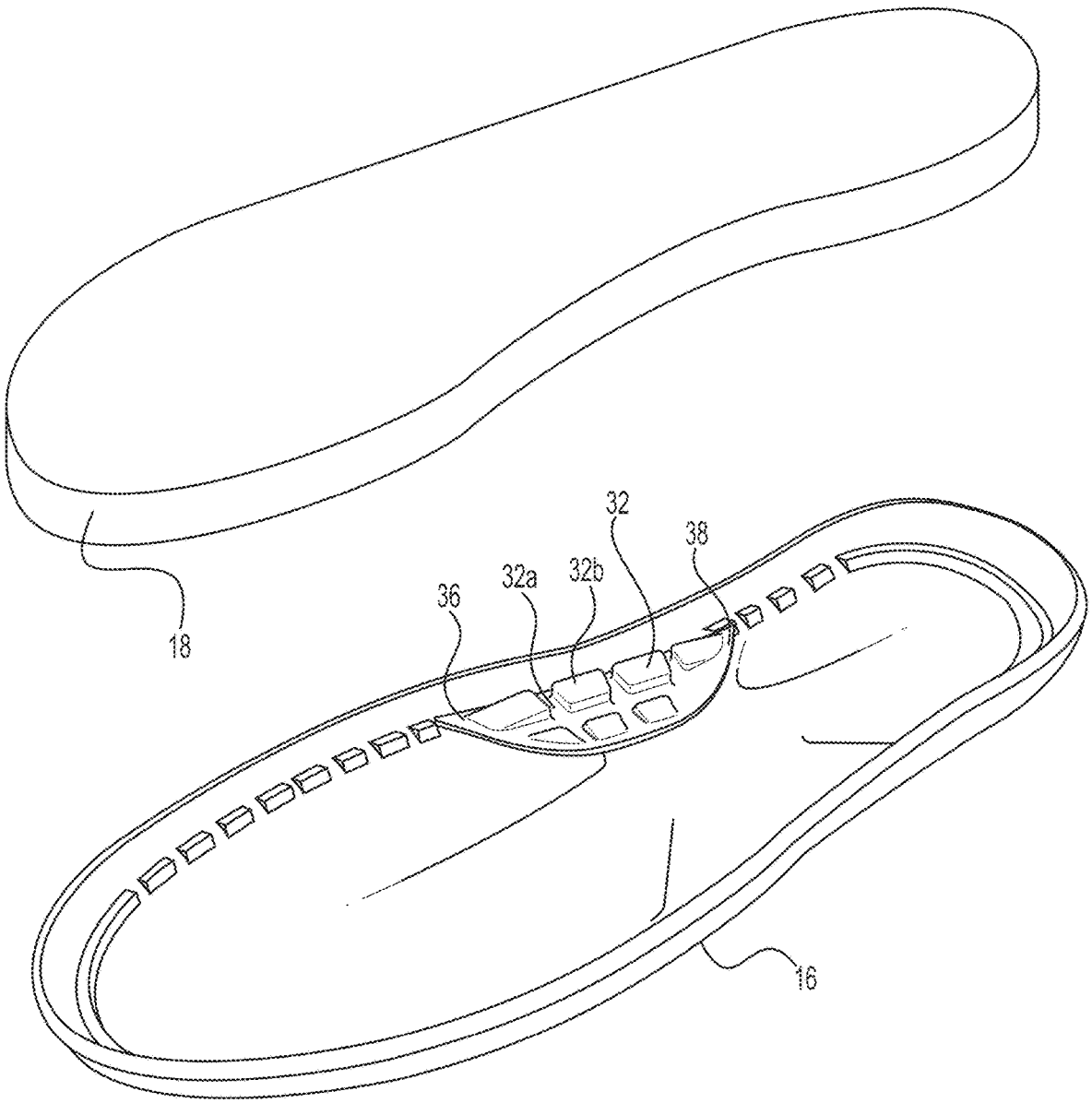
FIG. 5 is a perspective view of a midsole and arch support member of a footwear article according to the present invention.

In some aspects, the midsole 18 can further comprise an arch support region 30 disposed in the medial side arch region of the midsole. The arch support region 30 can comprise a an upper surface 18*b* of the midsole 18 and a plurality of arch cushion towers 32 extending upward from the upper surface 18*b* of the midsole 18. Each of the plurality of arch cushion towers 32 can comprise a substantially rectangular base 32*a* and an upper surface 32*b*, contoured to interface with an arch of a wearer's foot. Alternatively, the base 32*a* can have different shapes. For example, the base 32*a* can be generally circular, generally polygonal (e.g., hexagonal, octagonal, or the like), generally oval-shaped, or any other shape suitable for supporting the wearer's foot. In some aspects, the plurality of arch cushion towers 32 can be arranged in one or more rows extending along the metatarsal region of the midsole. Each of the arch cushion towers 32 can be individually compressible, such that compression of one arch cushion tower does not cause others of the plurality of arch cushion towers to be compressed. At least a portion of the arch support region 30 can be formed from a cushioning material, such as an EVA foam rubber. For example, one or more of the arch cushion towers 32 can be formed from a cushioning material. In some aspects, each of the plurality of cushion towers 32 can be formed from the same material. In other aspects, the plurality of cushion towers 32 can be formed from different materials, In other aspects, as shown in FIG. 5, an arch support member 36 can be attached to the outsole 16. The arch support member 36 can be formed as a separate component, comprising a base 38 and a plurality of arch cushion towers 32. The arch support member can be attached to the outsole 16. For example, the arch support member 36 can be attached to a medial side arch region of the outsole 16 by a chemical adhesive, by a plastic welding process, or by other means known in the art. In some aspects, the outsole 16 can comprise a flat portion configured to receive the arch support member 30. Each of the plurality of arch cushion towers 32 can comprise a substantially rectangular base 32*a* and an upper surface 32*b*, contoured to interface with an arch of a wearer's foot. Alternatively, the base 32*a* can have different shapes. For example, the base 32*a* can be generally circular, generally polygonal (e.g., hexagonal, octagonal, or the like), generally oval-shaped, or any other shape suitable for supporting the wearer's foot. In some aspects, the plurality of arch cushion towers 32 can be arranged in one or more rows extending along the metatarsal region of the midsole. Each of the arch cushion towers 32 can be individually compressible, such that compression of one arch cushion tower does not cause others of the plurality of arch cushion towers to be compressed. At least a portion of the arch support member 36 can be formed from a cushioning material, such as an EVA foam rubber. For example, one or more of the arch cushion towers 32 can be formed from a cushion material. In some aspects, each of the plurality of cushion towers 32 can be formed from the same material. In other aspects, the plurality of cushion towers 32 can be formed from different materials. The base 38 can be formed from a flexible material that can be affixed to the midsole 18. For example, the base 38 can be formed from one or more of cloth, an EVA foam rubber, a polyurethane, and/or the like.

As shown in FIG. 5, a midsole 18 can be disposed to substantially cover the outsole 16 and the arch support member 36. While the arch support member 36 is shown as being attached to the outsole, those of skill in the art will recognize that the arch support member 36 can be attached to other portions of the sole 10 (e.g., the midsole 18), provided that the arch support member is positioned in the medial side arch region of the sole.

Figure 6A:
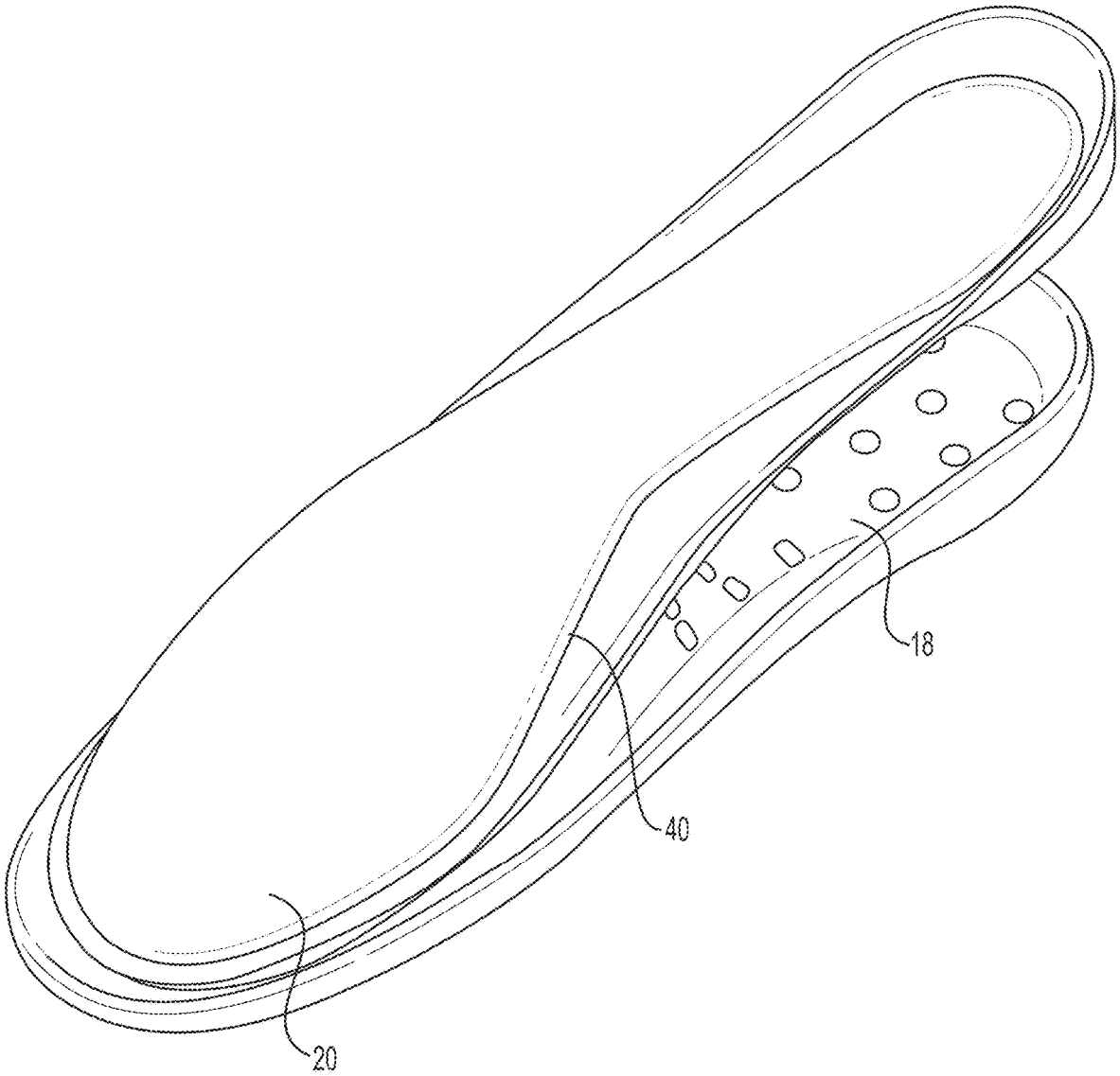
FIG. 6A is a perspective view of an insole and midsole of the footwear article according to the present invention.
Figure 6B:
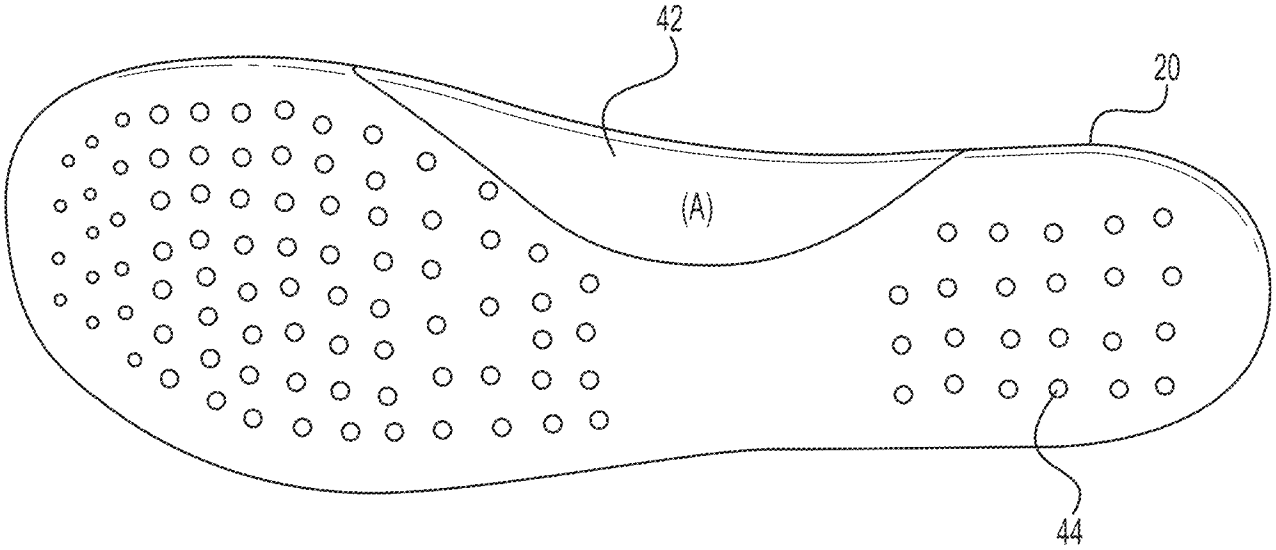
FIG. 6B is a bottom plan view of the insole of FIG. 5A.

FIG. 6A shows a perspective view of an insole 20. FIG. 6B shows a bottom view of the insole 20. The insole 20 can be a molded, cushioned insole. In some aspects, the insole 20 can be affixed to the midsole 18, such as by an adhesive. In other aspects, as shown in FIG. 6A, the insole 20 can rest atop the midsole 18. The insole 20 can further comprise stitching or compression lines 40 to define a medial side arch region of the insole and/or a heel portion of the insole. The insole 20 can be formed from one or more cushioning materials, such as EVA, memory foam, and other materials known in the art. As shown in FIG. 6B, the insole 20 can define a recessed area 42 that accommodates the arch cushion towers 32. In some aspects the insole 20 can define cavities 44 to facilitate airflow through the insole 20 and the footwear article 10.

What is claimed is:

1. A footwear article comprising: a sole defining a heel portion and a ball portion, the sole comprising an outsole, a midsole, and an insole;

an arch support member entirely and directly connected to and provided above an upper surface of the midsole confined to a medial side arch region of the midsole, wherein the upper surface of the midsole surrounds the medial side arch region of the midsole; the arch support member comprising a plurality of arch cushion towers extending upwards from the upper surface of the midsole, the plurality of arch cushion towers beginning and terminating within the medial side arch region of the midsole, and the upper surface of each of the plurality of arch cushion towers slopes downward toward the upper surface of the midsole surrounding the medial side arch region of the midsole, and wherein the arch cushion towers have flat lateral sides extending along the direction extending between the heel portion and the ball portion, each arch cushion tower elongated in a direction extending between the heel portion and the ball portion, and each having an elongated upper surface that is arcuate and/or angled to be contoured to interface with an arch of a foot, and the plurality of arch cushion towers each having a lower portion integrally connected to the midsole;

and an upper affixed to the midsole;

wherein the insole is disposed such that the insole rests on the upper surface of the midsole and covers the arch support member, and wherein the outsole is disposed such that an upper surface of the outsole covers the midsole including the lower portions of the arch cushion towers.

2. The footwear article of claim 1, wherein the arch support member is connected to the midsole by one or more of a chemical adhesive or a plastic weld.

3. The footwear article of claim 1, wherein the arch support member is formed integrally with the midsole.

4. The footwear article of claim 1, wherein each of the plurality of arch cushion towers is individually compressible.

5. The footwear article of claim 1, wherein the arch support member is formed from one or more cushioning materials.

6. The footwear article of claim 5, wherein at least a portion of the arch support member is formed from ethylene-vinyl acetate foam.

7. The footwear article of claim 1, wherein the plurality of arch cushion towers are arranged in rows.

8. The footwear article of claim 1, wherein the outsole includes a lower surface opposite the upper surface, and a plurality of tread elements extending from the lower surface of the outsole, wherein the lower surface of the outsole includes a toe end and a heel end, and a medial area between the toe end and the heel end, where the tread elements proximate the toe end and the heel end extend further from the lower surface of the outsole than the tread elements proximate the medial area.

9. A sole for a footwear article, the sole comprising:

an outsole having a lower surface and an upper surface, the lower surface of the outsole comprising a plurality of tread elements, wherein the lower surface of the outsole includes a toe end and a heel end, and a medial area between the toe end and the heel end, where the tread elements proximate the toe end and the heel end extend further from the lower surface of the outsole than the tread elements proximate the medial area;

a midsole affixed to the upper surface of the outsole;

an arch support member entirely and directly connected to and provided above an upper surface of the midsole confined to a medial side arch region of the midsole, wherein the upper surface of the midsole surrounds the medial side arch region of the midsole, the arch support member comprising a plurality of arch cushion towers extending upwards from the upper surface of the midsole, the plurality of arch cushion towers beginning and terminating within the medial side arch region of the midsole, and the upper surface of each of the plurality of arch cushion towers slopes downward toward the upper surface of the midsole surrounding the medial side arch region of the midsole, and wherein the arch cushion towers have flat lateral sides extending along the direction extending between the heel portion and the ball portion, each arch cushion tower elongated in a direction extending between the heel end and the toe end, and each having an elongated upper surface that is arcuate and/or angled to be contoured to interface with an arch of a foot, and the plurality of arch cushion towers each having a lower portion integrally connected to the midsole;

and an insole having an upper surface and a lower surface, the insole defining a recessed area in the lower surface sized to receive the arch support member, wherein the lower surface of the insole rests on the upper surface of the midsole and the recessed area of the insole covers the upper surfaces of the arch cushion towers and the outsole covers the lower portions of the arch cushion towers.

10. The sole for the footwear article of claim 9, wherein the arch support member is connected to the midsole by one or more of a chemical adhesive or a plastic weld.

11. The sole for the footwear article of claim 9, wherein the arch support member is formed integrally with the midsole.

12. The sole for the footwear article of claim 9, wherein each of the plurality of arch cushion towers is individually compressible.

13. The sole for the footwear article of claim 9, wherein the arch support member is formed from one or more cushioning materials.

14. The sole for the footwear article of claim 13, wherein at least a portion of the arch support member is formed from ethylene-vinyl acetate foam.

* * * * *